US007527159B2

(12) United States Patent
Brozell

(10) Patent No.: US 7,527,159 B2
(45) **Date of Patent: *May 5, 2009**

(54) THREADED CHILD-RESISTANT PACKAGE HAVING LINERLESS CLOSURE

(75) Inventor: Brian J. Brozell, Maumee, OH (US)

(73) Assignee: Rexam Closure Systems Inc., Perrysburg, OH (US)

( * ) Notice: Subject to any disclaimer, the term of this patent is extended or adjusted under 35 U.S.C. 154(b) by 639 days.

This patent is subject to a terminal disclaimer.

(21) Appl. No.: 10/799,115

(22) Filed: Mar. 11, 2004

(65) Prior Publication Data

US 2005/0199572 A1 Sep. 15, 2005

(51) Int. Cl.
*B65D 41/06* (2006.01)
*B65D 50/04* (2006.01)

(52) U.S. Cl. ..... 215/222; 215/332; 215/DIG. 1

(58) Field of Classification Search ..... 215/220–223, 215/331, 332, 339, 344, DIG. 1
See application file for complete search history.

(56) References Cited

U.S. PATENT DOCUMENTS 3,297,185 A 1/1967 Plymale
3,335,926 A 8/1967 Healy
3,339,770 A * 9/1967 Weigand ..... 215/214
3,485,403 A 12/1969 Hedgewick
3,610,454 A 10/1971 Malick
3,720,342 A 3/1973 Vercillo
3,809,276 A * 5/1974 Landen ..... 215/332
3,880,313 A 4/1975 Akers et al.
3,880,314 A 4/1975 Akers
3,917,096 A * 11/1975 Hedgewick ..... 215/211

(Continued)

FOREIGN PATENT DOCUMENTS

EP 0042603 12/1981

(Continued)

OTHER PUBLICATIONS

PCT Int'l Application No. PCT/US2004040587 Int'l Search Report and Written Opinion Dated: Nov. 4, 2005.

*Primary Examiner*—Anthony D Stashick
*Assistant Examiner*—James N Smalley
(74) *Attorney, Agent, or Firm*—Reising Ethington P.C.

(57) ABSTRACT

A closure and container constitute a child-resistant package. The container has a finish with an open mouth, at least one external thread adjacent to the open mouth, and at least one external radial projection on a side of the at least one external thread that is spaced from the open mouth. The closure has a base wall, a skirt with at least one internal thread adjacent to the base wall for engagement with the at least one external thread to thread the closure onto the finish, at least one internal locking lug spaced from the base wall, and an annular wall extending from the base wall at a position spaced radially inwardly from the skirt for resilient internal engagement with the open mouth of the container. The at least one internal locking lug is engageable with the at least one external radial projection when the closure is fully threaded onto the finish of the container and resiliency of the annular wall holds the at least one internal locking lug in axial engagement with the at least one external radial projection.

4 Claims, 5 Drawing Sheets

U.S. PATENT DOCUMENTS

| | | | | | |
|---|---|---|---|---|---|
| 3,944,102 | A | | 3/1976 | Grau | |
| 3,951,289 | A | | 4/1976 | Landen | |
| 3,952,899 | A | | 4/1976 | Cooke | |
| 3,979,001 | A | | 9/1976 | Bogert | |
| 4,032,028 | A | | 6/1977 | Reiss et al. | |
| 4,053,077 | A | | 10/1977 | DeFelice | |
| 4,084,716 | A | | 4/1978 | Bogert | |
| 4,090,629 | A | | 5/1978 | Hedgewick | |
| 4,091,948 | A | * | 5/1978 | Northup | 215/222 |
| 4,128,184 | A | | 12/1978 | Northup | |
| 4,139,112 | A | | 2/1979 | Cooke | |
| 4,159,779 | A | | 7/1979 | Hedgewick | |
| RE30,625 | E | * | 5/1981 | Akers | 215/211 |
| 4,270,664 | A | | 6/1981 | Buono | |
| 4,346,809 | A | | 8/1982 | Kusz | |
| 4,353,475 | A | | 10/1982 | Kachur | |
| 4,360,113 | A | | 11/1982 | Luker | |
| 4,375,858 | A | * | 3/1983 | Shah et al. | 215/217 |
| 4,387,817 | A | * | 6/1983 | Wiles et al. | 215/217 |
| 4,399,920 | A | * | 8/1983 | Swartzbaugh et al. | 215/211 |
| 4,410,097 | A | | 10/1983 | Kusz | |
| 4,434,903 | A | * | 3/1984 | Cooke | 215/222 |
| 4,523,688 | A | | 6/1985 | Puresevic | |
| 4,553,678 | A | * | 11/1985 | Thorsbakken | 215/218 |
| 4,560,077 | A | | 12/1985 | Dutt | |
| 4,579,238 | A | | 4/1986 | Herr | |
| 4,579,239 | A | | 4/1986 | Hart | |
| 4,598,835 | A | | 7/1986 | Brownbill | |
| 4,620,640 | A | | 11/1986 | Swartzbaugh | |
| 4,627,547 | A | | 12/1986 | Cooke | |
| 4,669,624 | A | | 6/1987 | Wiles | |
| 4,674,643 | A | | 6/1987 | Wilde | |
| 4,682,700 | A | | 7/1987 | Montgomery | |
| 4,739,890 | A | * | 4/1988 | Cooke | 215/222 |
| 4,823,967 | A | | 4/1989 | Thompson | |
| 5,020,682 | A | | 6/1991 | Dutt | |
| 5,105,960 | A | | 4/1992 | Crisci | |
| 5,133,471 | A | | 7/1992 | Almirall | |
| 5,135,124 | A | | 8/1992 | Wobser | |
| 5,147,053 | A | | 9/1992 | Friedenthal | |
| 5,161,706 | A | | 11/1992 | Weinstein | |
| 5,186,344 | A | | 2/1993 | Cook | |
| 5,279,434 | A | | 1/1994 | Aguirrezabal | |
| 5,317,796 | A | | 6/1994 | Hunter | |
| 5,449,078 | A | | 9/1995 | Akers et al. | |
| 5,462,186 | A | | 10/1995 | Ladina | |
| 5,687,863 | A | | 11/1997 | Kusz | |
| 5,769,268 | A | | 6/1998 | Kuzma | |
| 5,785,195 | A | | 7/1998 | Zwemer | |
| 5,803,287 | A | * | 9/1998 | Kusz | 215/330 |
| 5,836,466 | A | | 11/1998 | Briere et al. | |
| 5,915,576 | A | * | 6/1999 | Robinson | 215/216 |
| 6,056,143 | A | | 5/2000 | Stolzman | |
| 6,109,466 | A | | 8/2000 | Carrier | |
| 6,152,315 | A | | 11/2000 | Montgomery | |
| 6,327,770 | B1 | | 12/2001 | Konefal et al. | |
| 6,343,705 | B1 | | 2/2002 | Minnette | |
| 6,378,713 | B2 | | 4/2002 | Montgomery | |
| 6,446,823 | B2 | | 9/2002 | Miceli et al. | |
| 6,450,352 | B1 | | 9/2002 | DeJonge | |
| 6,508,373 | B1 | | 1/2003 | Robinson | |
| 6,523,709 | B2 | | 2/2003 | Miceli et al. | |
| 6,848,590 | B2 | | 2/2005 | Brozell | |
| 6,983,859 | B2 | * | 1/2006 | Azzarello | 220/288 |
| 2001/0035388 | A1 | | 11/2001 | Miceli et al. | |
| 2002/0062626 | A1 | | 5/2002 | Gregory | |
| 2002/0162817 | A1 | | 11/2002 | Vassallo | |
| 2002/0166834 | A1 | | 11/2002 | Branson et al. | |
| 2002/0195412 | A1 | | 12/2002 | Miceli et al. | |
| 2003/0075519 | A1 | | 4/2003 | Miceli et al. | |
| 2003/0098285 | A1 | | 5/2003 | Gregory et al. | |

FOREIGN PATENT DOCUMENTS

| | | |
|---|---|---|
| EP | 0281284 | 9/1988 |
| EP | 0528561 | 2/1993 |
| EP | 1302406 A | 4/2003 |
| EP | 1302406 A2 | 4/2003 |
| EP | 1302406 A3 | 8/2003 |
| GB | 2108095 | 5/1983 |
| GB | 2195620 | 4/1988 |
| GB | 2203136 | 10/1988 |
| GB | 2222821 | 3/1990 |

* cited by examiner

THREADED CHILD-RESISTANT PACKAGE HAVING LINERLESS CLOSURE

The present invention is directed to child resistant container and closure packages that resist opening by a child, and more particularly to a so-called push-and-turn package in which the closure is pushed axially against the container finish to permit rotation for removal.

BACKGROUND AND SUMMARY OF THE INVENTION

It is a general object of the present invention to provide a child resistant container and closure package, and a container and a closure for such a package.

In accordance with a first aspect of the present invention, a child-resistant package includes a container having a finish with an open mouth, at least one external thread adjacent to the open mouth, and at least one external radial projection spaced from the open mouth. The package also includes a closure having a base wall, a skirt with at least one internal thread adjacent to the base wall for engagement with the at least one external thread to thread the closure onto the finish, at least one internal locking lug on a side of the at least one internal thread spaced from the base wall, and an annular wall extending from the base wall at a position spaced radially inwardly from the skirt for resilient internal engagement with the open mouth of the container. The at least one internal locking lug is engageable with the at least one radial projection when the closure is fully threaded onto the finish of the container and resiliency of the annular wall holds the at least one internal locking lug in engagement with the projection.

A child-resistant closure in accordance with a second aspect of the present invention includes a base wall, and a skirt with at least one internal thread adjacent to the base wall for engagement with at least one external thread on a container finish to thread the closure onto the container finish. An annular wall extends from the base wall at a position spaced radially inwardly from the skirt for resilient internal engagement with an open mouth of the container finish. At least one internal locking lug is disposed on the skirt spaced from the base wall. The at least one internal locking lug is engageable with an external projection on a container finish, when the closure is fully threaded onto the container finish, and resiliency of the annular wall holds the at least one infernal locking lug in engagement with the external projection.

A container in accordance with a third aspect of the present invention includes a finish with an open mouth defined at least in part by an internal tapered surface. At least one external thread is disposed adjacent to the open mouth, and at least one external radial projection is disposed on a side of the thread spaced from the open mouth. The at least one external radial projection has a cam surface for interengagement with a cam surface of an internal locking lug of a closure.

BRIEF DESCRIPTION OF THE DRAWINGS

The invention, together with additional objects, features, advantages and aspects thereof, will be best understood from the following description, the appended claims and the accompanying drawings, in which:

DETAILED DESCRIPTION OF PREFERRED EMBODIMENTS

Figure 1:
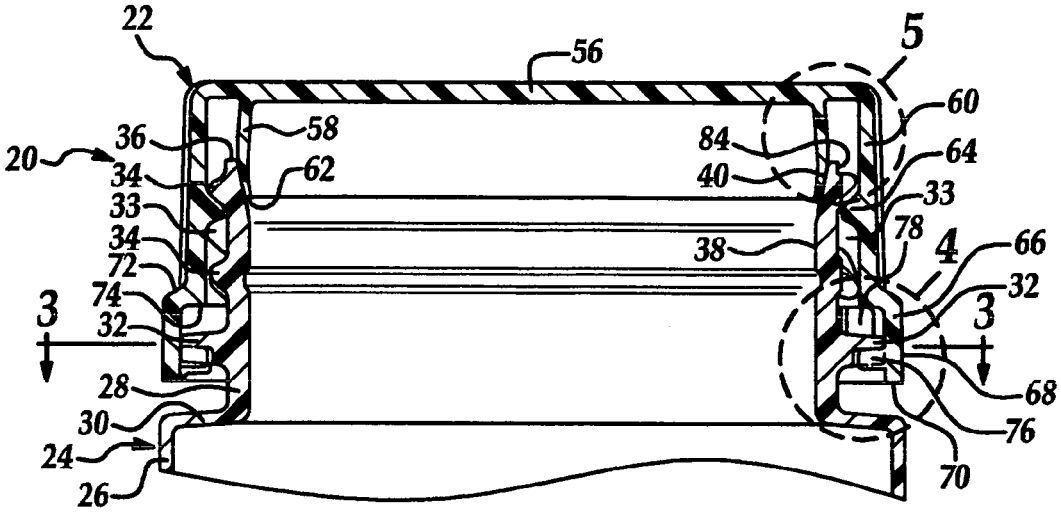
FIG. 1 is a fragmentary sectional view of a closure and container package according to one exemplary embodiment of the present invention.
Figure 2:
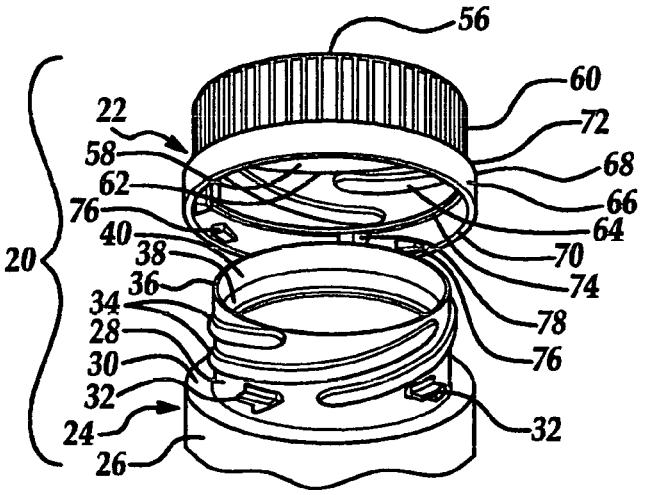
FIG. 2 is a fragmentary exploded view of the closure and container package of FIG. 1.

FIGS. 1 and 2 illustrate a child-resistant closure and container package 20 in accordance with a presently preferred embodiment of the invention as including a closure 22 threadingly secured to a container 24. The present invention is a so-called push-and-turn package, in which the closure 22 is pushed axially against the container 24 to overcome a spring-bias force to permit rotation of the closure 22 for removal from the container 24. The spring-bias force is provided without the use of a liner (not shown) that would typically be separately attached to the closure 22. As such, the present invention involves use of a linerless closure 22.

The container 24 is of one-piece integrally molded plastic construction having a closed bottom or base (not shown), a sidewall 26 extending axially away from the base, and a generally cylindrical finish 28 extending axially away from the sidewall 26. The diameter of the finish 28 is smaller than that of the sidewall 26, and the finish 28 is connected to the sidewall 26 by a shoulder 30. Just axially displaced from the shoulder 30, there are formed at least one, and preferably four external radially extending lugs or child-resistant projections 32. Likewise, just axially displaced from the projections 32, there is formed at least one external thread 34 that extends partially around the circumference of the finish 28. The finish 28 axially terminates in an end 36, which is connected to an inner surface 38 of the finish 28 by a tapered surface 40, which at least partially defines an open mouth of the container 24.

Figure 12:
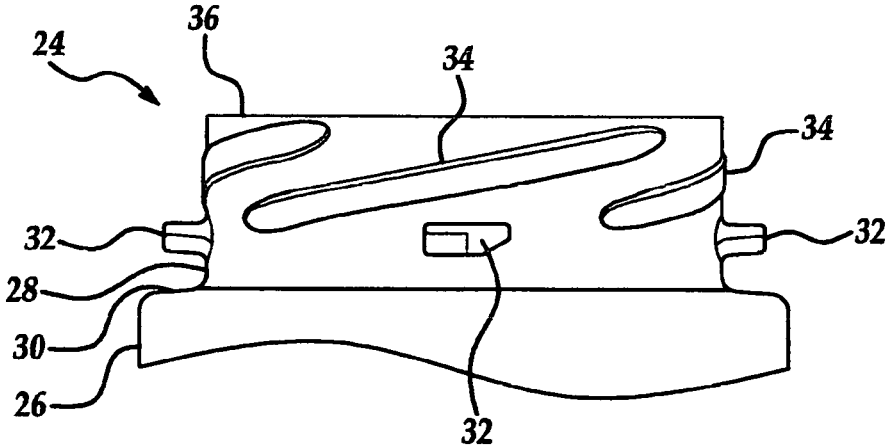
FIG. 12 is a fragmentary elevational view of the container of FIG. 1.
Figure 13:
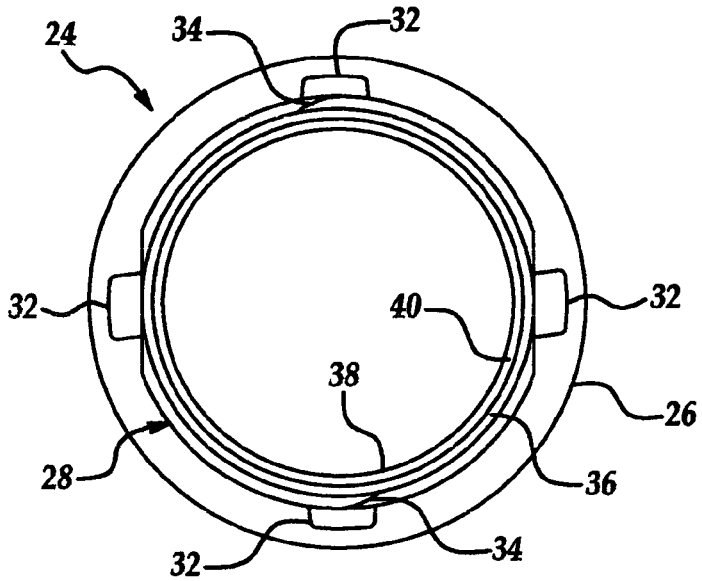
FIG. 13 is a top plan view of the container of FIG. 1.
Figure 14:
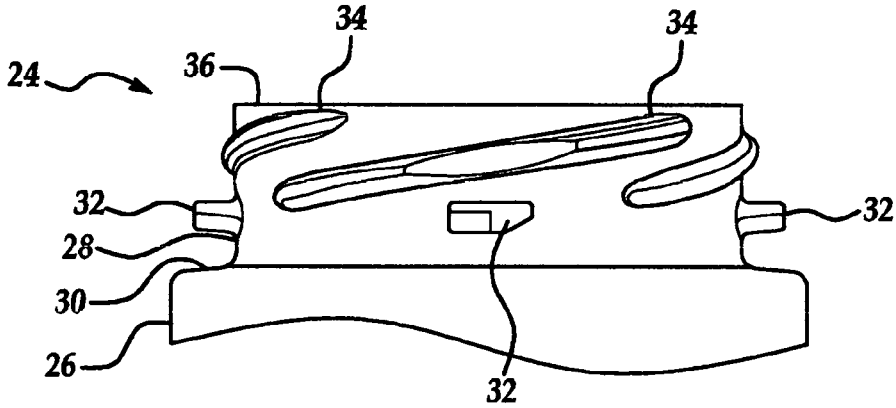
FIG. 14 is a fragmentary elevational view of the container of FIG. 1, that is clocked one-quarter turn compared to the view of FIG. 12.
Figure 15:
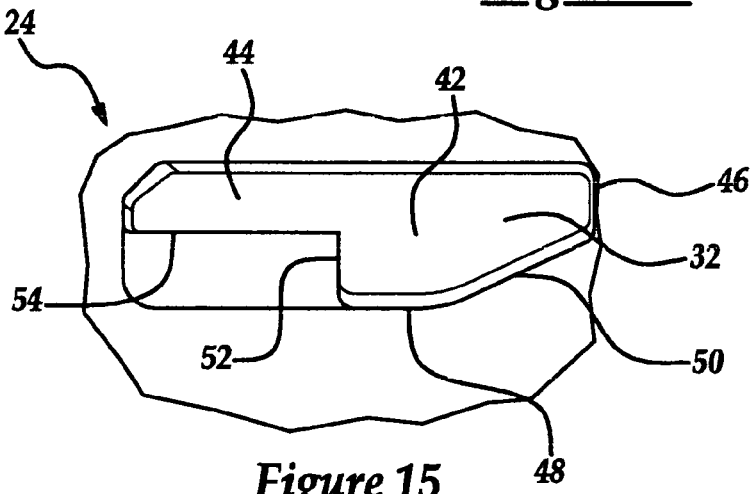
FIG. 15 is an enlarged fragmentary elevational view of a portion of the container of FIG. 1

FIGS. 12 through 14 further illustrate the threads 34 and projections 32 of the finish 28 of the container 24. FIG. 13 also illustrates the inner surface 38, the tapered surface 40, and the end 36 of the finish 28. FIG. 15 shows one of the projections 32 having an axial leg portion 42 at a counter-clockwise end of a flange or tangential leg portion 44. The axial leg portion 42 includes a circumferentially-facing thread stop surface 46, an axially-facing bottom surface 48, and a cam surface 50 extending therebetween. The tangential leg portion 44 of the projection 32 includes a circumferentially-facing child-resistant stop surface 52 disposed opposite of the thread stop surface 46 and that extends between the bottom surface 48 and an axially-facing child-resistant retaining surface 54.

Referring again to FIGS. 1 and 2, the closure 22 is of plastic construction, and includes a transversely extending base wall 56, a spring member or inner annular wall 58 depending axially away from the base wall 56 for resilient internal engagement with the open mouth of the container 24, and an outer annular skirt 60 depending axially away from the base wall 56 for fastening the closure 22 to the finish 28 of the container 24. The inner annular wall 58 is disposed radially inwardly of the skirt 60 and extends generally axially, but is also reverse tapered such that it angles radially outwardly from the base wall 56 to an open end 62. The skirt 60 includes at least one internal thread 64 adjacent to the base wall 56 for engagement with the external thread 34 of the container 24 to thread the closure 22 onto the finish 28 of the container 24. The skirt 60 further includes an enlarged skirt portion 66 having an outer surface 68 and axially terminating the skirt 60 at an open end 70 opposite of the base wall 56. The enlarged skirt portion 66 is connected to the rest of the skirt 60 by an outer shoulder 72 and an inner shoulder 74. Proximate to the open end 70, there extends radially inwardly at least one child resistant lug or locking lug 76, and proximate to the inner shoulder 74 there radially inwardly extends at least one stop lug 78 for preventing overthreading or overtightening of the closure 22 onto the container 24. The locking lug 76 on the closure 22 circumferentially engages the corresponding radially extending projection 32 on the container 24 when the closure 22 is fully threaded onto the finish 28 of the container 24, and resiliency of the inner annular wall 58 biases the locking lug 76 into axial engagement with the projection 32, as will be further described below.

Figure 7:
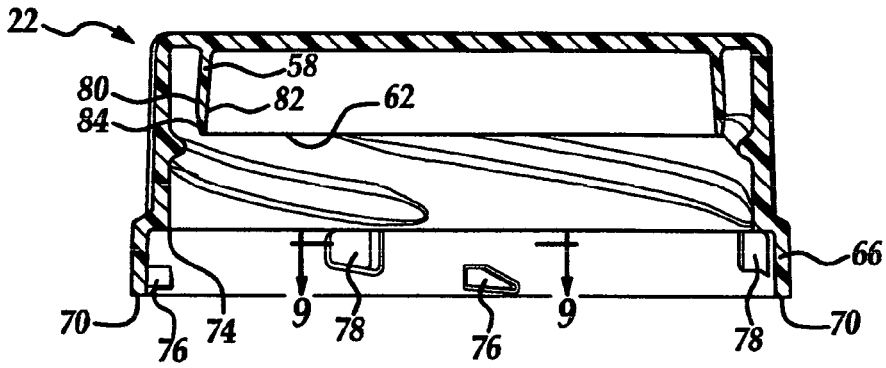
FIG. 7 is a sectional view of the closure of FIG. 1.

FIGS. 7 through 11 further illustrate the various features of the closure 22 in finer detail. For example, FIG. 7 shows the inner annular wall 58 having an outer surface 80 disposed opposite of an inner surface 82, the open end 62, and an angled cam surface 84 extending therebetween. FIG. 7 also serves to illustrate the axial relationship between the locking lugs 76 and the stop lugs 78, wherein the locking lugs 76 are positioned just axially above the end 70 of the enlarged skirt portion 66 and the stop lugs 78 are positioned just axially below the inner shoulder 74. Accordingly, the stop lugs 78 are positioned just axially above the locking lugs 76.

Figure 8:
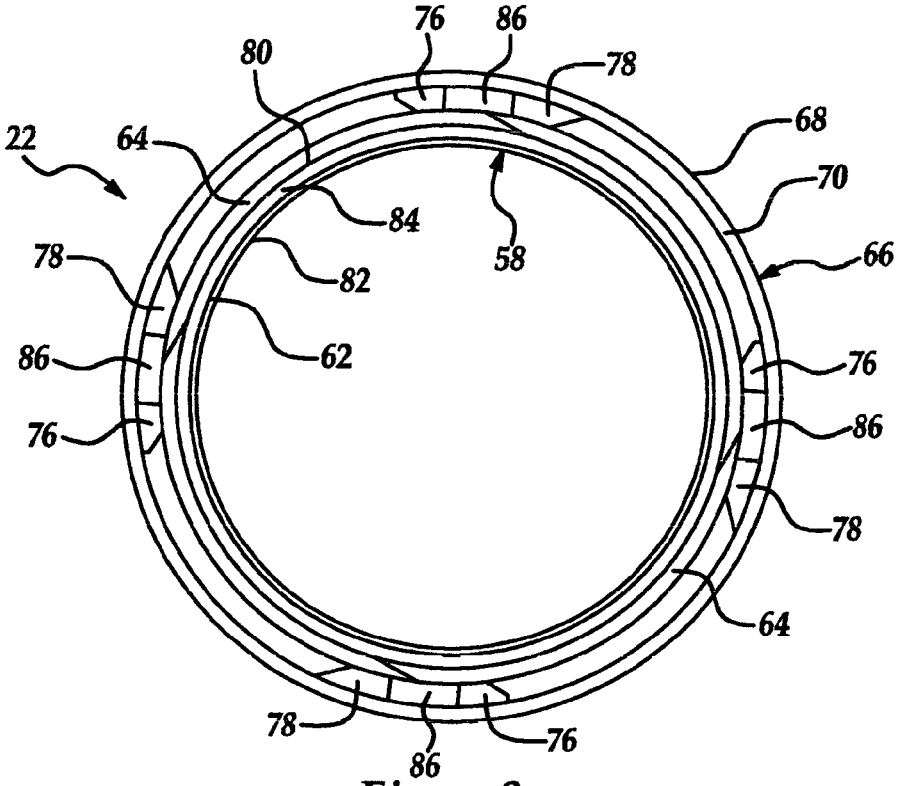
FIG. 8 is bottom plan view of the closure of FIG. 7.

FIG. 8 illustrates a bottom plan view of the closure 22. Working radially outwardly, there is shown the inner annular wall 58 having the inner surface 82, the open end 62, the cam surface 84, and the outer surface 80. Also shown are the threads 64, and the locking lugs 76 and stop lugs 78 with circumferentially disposed gaps 86 therebetween wherein the projections 32 (FIG. 2) of the container finish 28 reside when the closure 22 is fastened to the container 24. Finally, the open end 70 and outer surface 68 of the enlarged skirt portion 66 are shown.

Figure 9:
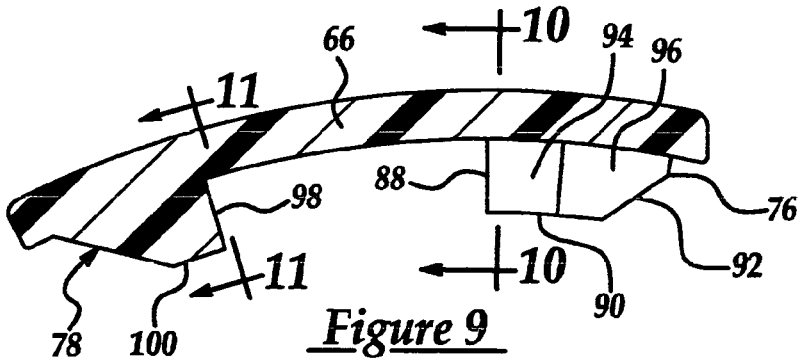
FIG. 9 is a sectional view of the closure of FIG. 7, taken along line 9-9.

FIG. 9 further illustrates the axial relationship between the stop lugs 78 and the locking lugs 76, wherein the enlarged skirt portion 66 and stop lug 78 are shown in cross-section and the locking lug 76 is shown in solid. The locking lug 76 includes a circumferentially-facing child-resistant stop surface 88, a radially inner surface 90 connected to the stop surface 88, and an angled surface 92 connected to the radially inner surface 90. The locking lug 76 also includes an axial retaining surface 94 and an angled cam surface 96 connected thereto for engagement with the projection 32 on the finish 28 of the container 24 (FIG. 1).

Figure 10:
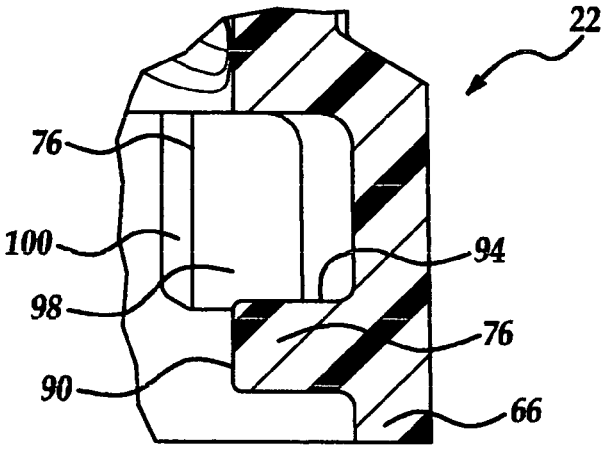
FIG. 10 is a sectional view of the closure of FIG. 9, taken along line 10-10.
Figure 11:
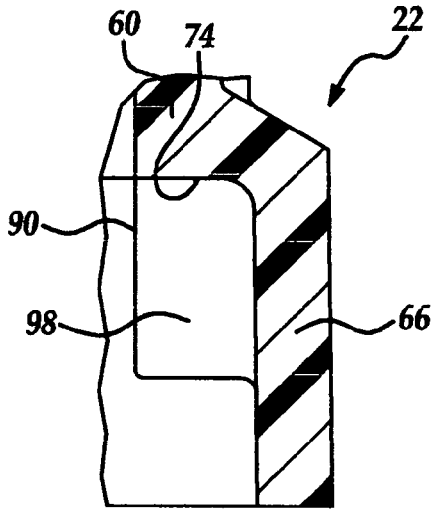
FIG. 11 is a sectional view of the closure of FIG. 9, taken along line 11-11.

The axial retaining surface 94 and the radially inner surface 90 of the locking lug 76 are also shown in FIG. 10, wherein the locking lug 76 integrally extends radially inwardly from the enlarged skirt portion 66. As can also be seen in FIG. 10, as well as FIG. 9, the stop lug 78 includes a circumferentially-facing thread stop surface 98 that is connected to a radially inner surface 100 and that engages the projection 32 on the finish 28 of the container 24 (FIG. 1). As shown in FIG. 11, the radially inner surface 90 extends axially downwardly from the inner shoulder 74 of the skirt 60 and the thread stop surface 98 extends radially inwardly from the enlarged skirt portion 66.

Figure 5:
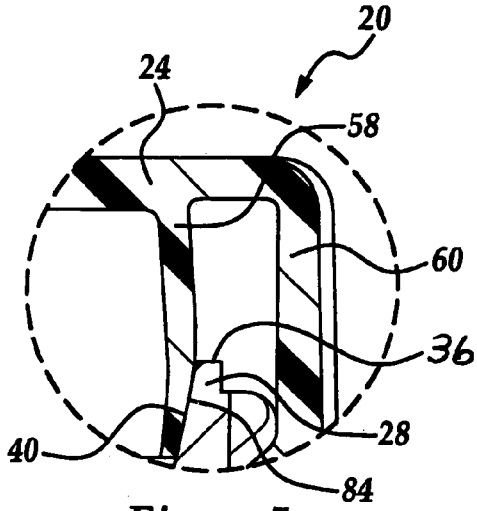
FIG. 5 is an enlarged view of the portion of FIG. 1 within the circle 5.

Referring again to FIGS. 1 and 2, the closure 22 is applied to the container 24 by aligning the enlarged skirt portion 66 of the closure 22 over the finish 28 of the container 24 and rotating the closure 22 with respect thereto, such that the threads 64 of the closure 22 threadingly engage the threads 34 on the finish 28 of the container 24. Continued rotation of the closure 22 will eventually lead to initial engagement of the inner annular wall 58 of the closure 22 with the open mouth of the container 24. As also depicted in FIG. 5, the angled surface 84 of the inner annular wall 58 of the closure 22 sealingly engages the corresponding angled surface 40 of the finish 28 of the container 24 to ensure circumferential surface contact sealing between the closure 22 and the container 24. As such, no separate liner member of any kind is needed be attached to the closure 22 for sealing purposes. As the closure 22 is threaded toward the container 24, the angled surface 40 on the finish 28 tends to compress the inner annular wall 58 in a radially inward direction, thereby creating resistance to further axial displacement of the closure 22. Thus, the mating taper arrangement will have the effect of biasing the closure 22 in an axial direction away from the container 24. In turn, and referring again to FIG. 1, this biasing effect urges the locking lugs 76 of the closure 22 into upward axial engagement with the projections 32 of the finish 28 of the container 24, until such biasing effect is overcome by a downward force imposed on the closure 22 at which time the closure 22 can be unthreaded from the container 24, as will be discussed in more detail below. In other words, the inner annular wall 58 is flexibly engageable with the tapered surface 40 of the container 24 under a diametrical interference fit, whereby such fit yields a bias force on the inner annular wall 58 thereby generating a resultant upward axial force that tends to maintain the locking lug 76 in substantial circumferential alignment with the projection 32 of the container 22.

Continued rotation of the closure 22 with respect to the container 24 will also lead to initial engagement between the locking lugs 76 of the closure 22 and the radial projections 32 of the finish 28. Specifically, as shown in FIG. 6A, the cam surface 96 of the locking lug 76 of the closure 22 initially engages the cam surface 50 of the radial projection 32. As the closure 22 is further rotated, the locking lug 76 passes under the radial projection 32 by virtue of the cooperating cam surfaces 50, 96 and, as shown in FIG. 6B. The stop surface 98 of the stop lug 78 eventually engages the stop surface 46 of the projection 32 so as to stop rotation of the closure 22 and thereby prevent overthreading and resulting damage to the closure 22. Specifically, the stop lug 78 prevents overtightening whereby the inner annular wall 58 (FIG. 1) becomes overstressed and permanently deformed. As also shown in FIG. 6B, the locking lug 76 passes almost entirely beyond the radial projection 32, but not quite. Rather, the locking lug 76 is shown axially covered or entrapped by the tangential leg portion 44 of the radial projection 32, wherein there is shown an axial space between the retaining surfaces 54, 94 that is the result of downward pressure being applied to the closure 22 as it is fastened to the container 24 (FIG. 1).

Figure 3:
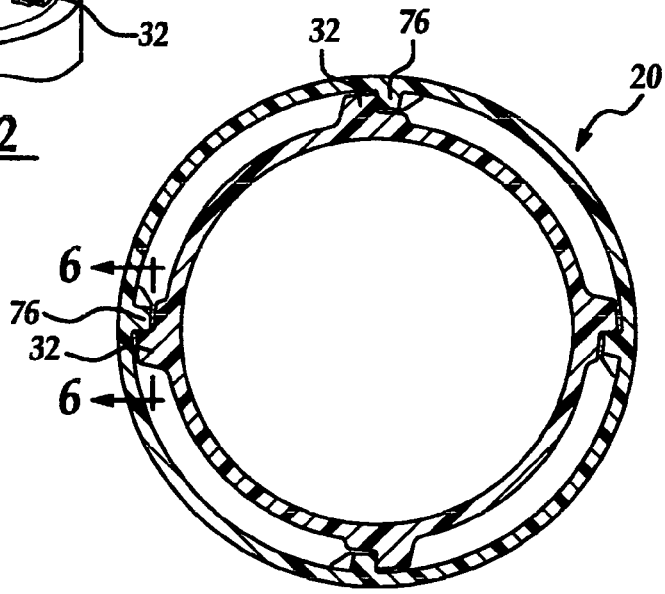
FIG. 3 is a sectional view taken substantially along line 3-3 of FIG. 1.
Figure 4:
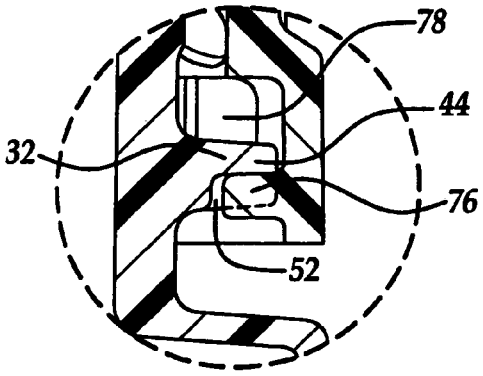
FIG. 4 is an enlarged view of the portion of FIG. 1 within the circle 4.
Figure 6:
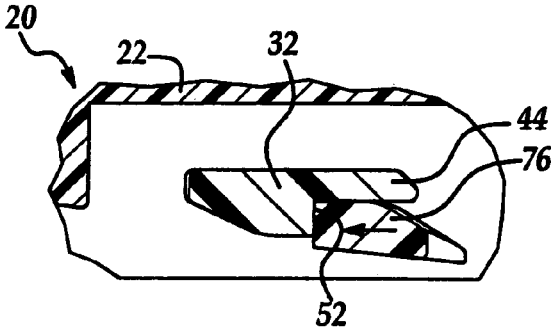
FIG. 6 is an enlarged sectional view of the closure and container package taken substantially along line 6-6 of FIG. 3.
Figure 6A:
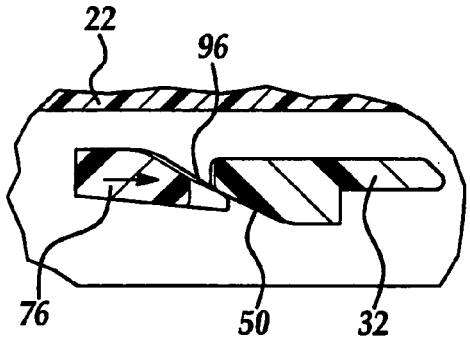
FIG. 6A is a modified view of the closure and container package of FIG. 6 illustrating a portion of a container and a portion of a closure which are in initial engagement with one another.
Figure 6B:
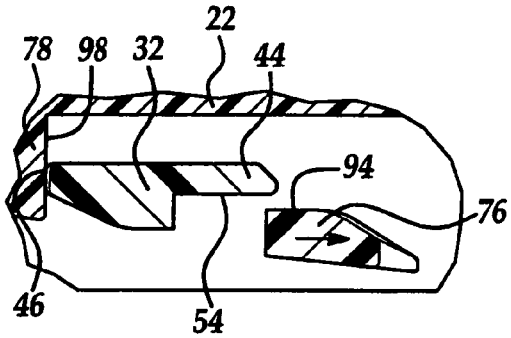
FIG. 6B is a modified view of the closure and container package of FIG. 6A illustrating the portion of the container and the portion of the closure which have been rotated past one another.

FIG. 6 illustrates the closure and container package 20 in a closed state of rest after application of the closure 22, wherein the tangential leg portion 44 of the projection 32 axially entraps the locking lug 76 and the child-resistant stop surface 52 of the projection 32 circumferentially stops the locking lug 76 in a counter-clockwise rotational direction, such that the closure 22 cannot be removed. FIG. 4 illustrates the same closed state of rest as FIG. 6, wherein the radial projection 32 is circumferentially entrapped between the stop lug 78 and the locking lug 76 and wherein the locking lug 76 is axially entrapped in an upward direction by the tangential leg portion 44 of the radial projection 32. FIG. 3 further illustrates the closed state of rest wherein it is clear that the radial projections 32 prevent counter-clockwise displacement of the locking lugs 76.

Figure 6C:
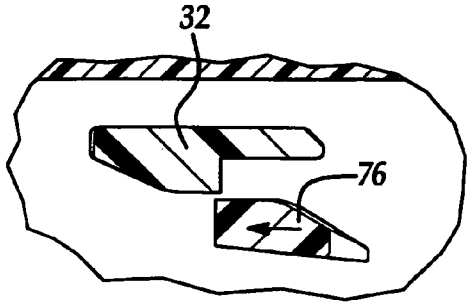
FIG. 6C is a modified view of the closure and container package of FIG. 6 illustrating the portion of the container being axially and circumferentially displaced in a counter-clockwise direction with respect to the portion of the closure.

Referring again to FIG. 1, the closure 22 cannot be removed from the container 24 merely by rotating the closure 22 in a counter-clockwise direction. Rather, the closure 22 is removed from the container 24 by first imposing a downward force on the closure 22 to overcome the upward bias force created by the interengaged inner axial wall 58 and the open mouth of the closure 22 and container 24 respectively. Such downward force enables axial displacement of the closure 22 with respect to the container 24 into axial spaces 33 between the threads 64 of the closure 22 and the threads 34 of the container 24. Referring now to FIG. 6C, by virtue of the axial displacement described above, the locking lug 76 may now rotate counter-clockwise and freely pass beneath the radial projection 32. As shown in FIG. 2, the closure 22 may be unthreaded and removed from the container 24.

There have thus been described a closure 22, a container 24, and a closure and container package 20 that fully satisfy all of the objects and aims previously set forth. The present invention has been disclosed in conjunction with presently preferred embodiments thereof, and a number of modifications and variations have been discussed. Other modifications and variations will readily suggest themselves to persons of ordinary skill in the art in view of the foregoing description. The invention is intended to embrace all such modifications and variations as fall within the spirit and broad scope of the appended claims.

The invention claimed is:

1. A child-resistant package including a container having a finish with an open mouth, at least one unbroken external thread adjacent to said open mouth, and at least one external radial projection spaced from said at least one external thread on a side of said at least one external unbroken thread spaced from said open mouth, and a closure having a base wall, a skirt with at least one unbroken internal thread adjacent to said base wall for engagement with said at least one external unbroken thread to thread said closure onto said finish, at least one internal locking lug spaced from said base wall and spaced from said at least one internal thread, and an annular wall extending from said base wall at a position spaced radially inwardly from said skirt for resilient internal engagement with said open mouth of said container, said at least one internal locking lug being engageable with said at least one radial projection when said closure is fully threaded onto said finish of said container and resiliency of said annular wall holding said at least one internal locking lug in engagement with said at least one external radial projection to provide child resistance for said package, said closure including at least one internal stop lug on said skirt adjacent to but spaced from said at least one internal locking lug on said skirt for engagement with said at least one external radial projection on said finish to prevent over-tightening of said closure on said finish of said container, wherein said at least one external radial projection on said finish is located on a side of said at least one external thread opposite of said open mouth, and has a tangential leg portion and an axial leg portion at a counterclockwise end of said tangential leg portion, said tangential leg portion axially trapping said at least one internal locking lug on said skirt against a spring force of said annular wall to provide said child resistance for said package, wherein said closure skirt includes a first portion with a first internal surface on which said at least one unbroken internal thread is disposed, and an enlarged second portion connected to the first portion by inner and outer shoulders of said closure skirt and terminating at an open end opposite of said base wall and having a second internal surface stepped radially outwardly from said first internal surface of said first portion and on which said at least one locking lug and said at least one stop lug are disposed, and said at least one locking lug is positioned proximate and just axially above said open end of said enlarged second portion and said at least one stop lug is positioned proximate and just axially below said inner shoulder of said closure skirt, wherein said axial portion of said at least one external radial projection on said container includes a cam surface and said at least one internal locking lug of said closure includes a cam surface, and wherein said cam surfaces cooperate to initially engage said at least one external radial projection and said at least one locking lug for securing said closure to said container in a child resistant manner.

2. The package as set forth in claim 1, wherein said annular wall is reverse tapered from said base wall such that said annular wall angles radially outwardly from the base wall and terminates in an open end.

3. The package as set forth in claim 2, wherein said annular wall includes an outer surface and an angled surface between said outer surface and said open end.

4. The package as set forth in claim 3, wherein said open mouth is at least partially defined by an angled surface that cooperates with said angled surface of said annular wall of said closure to produce a spring force that tends to separate said closure from said container.

* * * * *